US009604252B2

(12) United States Patent
Younos et al.

(10) Patent No.: US 9,604,252 B2
(45) Date of Patent: Mar. 28, 2017

(54) PROCESS FOR COATING CONTAINERS

(71) Applicant: Conopco, Inc., Englewood Cliffs, NJ (US)

(72) Inventors: Omer Bin Younos, Vlaardingen (NL); Christopher Norman Allinson, Ness (GB); Geoffrey William Vernon, Fringford (GB); Luca Mario Volpe, Higham-on-the-Hill (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 14/890,808

(22) PCT Filed: May 15, 2014

(86) PCT No.: PCT/EP2014/059951
§ 371 (c)(1),
(2) Date: Nov. 12, 2015

(87) PCT Pub. No.: WO2014/187725
PCT Pub. Date: Nov. 27, 2014

(65) Prior Publication Data

US 2016/0074901 A1 Mar. 17, 2016

Related U.S. Application Data

(60) Provisional application No. 61/825,159, filed on May 20, 2013.

(51) Int. Cl.
*B05D 7/22* (2006.01)
*B05D 1/00* (2006.01)
(Continued)

(52) U.S. Cl.
CPC ..... *B05D 7/222* (2013.01); *B05B 13/0681* (2013.01); *B05D 1/002* (2013.01);
(Continued)

(58) Field of Classification Search
CPC . B05D 1/002; B05D 1/02; B05D 5/00; B05D 5/08; B05D 7/02; B05D 7/22; B05D 7/222; B05D 7/24; B05D 2201/02
(Continued)

(56) References Cited

U.S. PATENT DOCUMENTS 2,120,640 A 6/1938 Craemer
3,804,663 A 4/1974 Clark
(Continued)

FOREIGN PATENT DOCUMENTS

EP 0659652 6/1995
EP 1542905 2/2004
(Continued)

OTHER PUBLICATIONS

IPRP1 in PCTEP2012073262, Jun. 27, 2014, WO (NPL 1; pp. 1-8).
(Continued)

*Primary Examiner* — William Phillip Fletcher, III
(74) *Attorney, Agent, or Firm* — Ellen Plotkin

(57) ABSTRACT

A process for coating inside a container includes rotating the container about its imaginary vertical axis while simultaneously lowering airless spray nozzles along the vertical axis of the container into the cavity through the opening end and moving the nozzles back up and out of the container. Spray nozzles are used to apply a liquid coating at a spray pressure of about 100 to about 800 psi (6.89 to 55.16 bar) and at an angle of about 0 to about 120 degrees relative to the vertical axis, simultaneously with nozzle movement, to at least a portion of the inner surface while the container is rotating and the nozzles are moving along the vertical axis. The container is thereby coated on its inner surface to form an internally coated container.

3 Claims, 7 Drawing Sheets

(51) Int. Cl.

| | |
|---|---|
| ***B05D 1/02*** | (2006.01) |
| ***B05B 13/06*** | (2006.01) |
| ***B65D 23/02*** | (2006.01) |
| ***B05D 7/24*** | (2006.01) |
| ***B05D 5/08*** | (2006.01) |
| ***B05D 5/00*** | (2006.01) |
| *B67C 3/06* | (2006.01) |
| *B05D 7/02* | (2006.01) |

(52) U.S. Cl.
CPC ..... *B05D 1/02* (2013.01); *B05D 5/00* (2013.01); *B05D 5/08* (2013.01); *B05D 7/22* (2013.01); *B05D 7/227* (2013.01); *B05D 7/24* (2013.01); *B65D 23/02* (2013.01); *B05D 7/02* (2013.01)

(58) Field of Classification Search
USPC ..... 426/394; 427/230–239
See application file for complete search history.

(56) References Cited

U.S. PATENT DOCUMENTS

| | | | | |
|---|---|---|---|---|
| 4,069,933 | A * | 1/1978 | Newing | B29C 49/0005 215/12.2 |
| 4,098,745 | A | 7/1978 | Borman | |
| 4,606,942 | A * | 8/1986 | Shriver | B05B 13/0609 118/317 |
| 5,378,510 | A | 1/1995 | Thomas et al. | |
| 5,565,248 | A | 10/1996 | Plester et al. | |
| 5,704,983 | A | 1/1998 | Thomas et al. | |
| 6,149,982 | A | 11/2000 | Plester | |
| 6,247,603 | B1 | 6/2001 | Farrell et al. | |
| 6,461,699 | B1 | 10/2002 | Slat et al. | |
| 8,003,178 | B2 | 8/2011 | Kim et al. | |
| 2001/0042510 | A1 | 11/2001 | Plester | |
| 2002/0122883 | A1 | 9/2002 | Slat et al. | |
| 2004/0062860 | A1 | 4/2004 | Nakashima et al. | |
| 2004/0065841 | A1 | 4/2004 | Darr et al. | |
| 2004/0091650 | A1 | 5/2004 | Krempel-Hesse et al. | |
| 2008/0286480 | A1 | 11/2008 | Kim et al. | |
| 2012/0080450 | A1 | 4/2012 | Dziersk et al. | |

FOREIGN PATENT DOCUMENTS

| | | |
|---|---|---|
| EP | 1980493 | 10/2008 |
| EP | 1992567 | 7/2011 |
| FR | 2817175 | 7/2003 |
| GB | 227169 | 1/1925 |
| GB | 585213 | 2/1947 |
| GB | 702292 | 1/1954 |
| GB | 835412 | 5/1960 |
| GB | EP260827 | 3/1988 |
| JP | 2006249278 | 9/2006 |
| JP | 2008260800 | 10/2008 |
| JP | 2008297379 | 12/2008 |
| KR | 20120038185 | 4/2012 |
| KR | 20120038185ABS | 4/2012 |
| WO | WO2004012999 | 2/2004 |
| WO | WO2004042111 | 5/2004 |
| WO | WO2011011705 | 1/2011 |
| WO | WO2011011707 | 1/2011 |

OTHER PUBLICATIONS

IPRP2 in PCTE02014059951, Oct. 14, 2015 (NPL 1; pp. 9-20).
Search Report in EP12158798, Oct. 5, 2012 (NPL 1; pp. 21-22).
Search Report in PCTEP2012073262, Feb. 20, 2013 (NPL 1; pp. 23-26).
Search Report in PCTEP2014059951, Aug. 4, 2014 (NPL 1; pp. 27-29).
Written Opinion 1 in PCTEP2014059951, Aug. 4, 2014 (NPL 1; pp. 30-35).
Written Opinion 2 in PCTEP2014059951, Apr. 21, 2015 (NPL 1; pp. 36-41).
Written Opinion EP12158798, Oct. 5, 2012 (NPL 1; pp. 42-45).
Written Opinion in PCTEP2012073262, Feb. 20, 2013 (NPL 1; pp. 46-53).

* cited by examiner

PROCESS FOR COATING CONTAINERS

FIELD OF THE INVENTION

The invention is related to a process for coating the inside of a container. In particular, the invention is related to a coating process by moving a spray nozzle into a rotating container along the vertical axis of the container and spray coating the interior of the container while the nozzle is moving inside the container.

BACKGROUND OF THE INVENTION

Complete evacuation of viscous products has been a goal for consumers. Squeeze containers have been found to work best for helping evacuate product by application of manual force by the consumer. Bottom opening containers have been found advantageous for helping with evacuation by employing the force of gravity to help push and discharge viscous product out through an orifice. An example of a bottom opening container is in co-pending U.S. patent application Publication No. US2012/0080450.

Coated containers have been employed to further assist with viscous product evacuation. For example, U.S. Pat. No. 8,003,178 discloses partial coating inside a container. A disadvantage is that it is extremely difficult if not impossible to completely coat the bottle, especially at the shoulder or neck portion. U.S. Pat. No. 6,247,603 discloses a completely coated dispensing apparatus for increasing product removal. There is a risk of over exposing the oil to oxygen when combining the oil with pressurized air via a nozzle, and creating an air/coating mist.

After the dispenser has been used several times, tiny remains of the viscous product (e.g. food product) still tend to adhere to the container walls. While use of squeezable upside down coated containers is helpful, there remains a need for more complete evacuation of viscous products from a plastic container and for better and more efficient methods and equipment for coating the containers.

SUMMARY OF THE INVENTION

The present invention is motivated by a need for more complete evacuation of viscous products from a plastic container and for more efficient and more accurately controlled methods for consistently coating the inside surfaces of containers.

The invention provides a process for coating the inside of a container 10 (at least partially deformable) using an adapted apparatus. In particular, the process for coating a container 10 includes the following steps:

(a) providing a container 10 having a closed end and an opening end, and further having an imaginary central vertical axis 17 extending from its closed end to its opening end, characterized by the container 10 comprising:
  (i) a cavity delimited by a wall between the closed end and the open end;
  (ii) the wall comprising an inner surface 25;
  (iii) a neck finish 14 at an opening end of the container 10 opposite the closed end; the container neck 14 terminating in a sealing surface 30 at the opening end;

(b) rotating the container 10 about its vertical axis 17;

(c) lowering an airless spray nozzle assembly 21 along the vertical axis 17 of the container 10 into the cavity through the opening end; the spray nozzle assembly 21 having at least two nozzles 20 with each having orifices therein having an equivalent diameter of 50 to 200 microns;

(d) applying a liquid coating through the nozzle assembly 21 at a spray pressure of 100 to 800 psi (6.89 to 55.16 bar) and at an angle of 0 to 120 degrees relative to the vertical axis, simultaneously with nozzle movement, to coat the inner surface 25 while the container 10 is rotating and the nozzle assembly 21 is moving along the vertical axis 17;

thereby coating the inner surface 25 to form an internally coated container.

Substantially complete coating is achieved with the overlap of successive fan patterns, which fills in gaps, while the container 10 rotational speed imparts energy into the coating, causing it to migrate, giving better coverage. The action of centrifugal force from container 10 rotation is believed, without being bound by theory, to contribute to achieving a uniform coating by causing the oil layer to flatten out. The container 10 rotation may be effected by placing the container 10 on a rotating plate or by holding the container by its neck 14. The nozzle assembly facilitates control of coating height on the inner surface of the container 10. The nozzle assembly as used in the present process provides for a uniform coating to a selected height on the inner surface of the container 10.

Preferably, the container 10 is made from a plastic material, most preferably from PET due to ease of recyclability. More preferably, the plastic container 10 is at least partially deformable or squeezable. The inventive process is particularly preferred for a bottom opening container 10. Preferably, the coating has a viscosity at 20° C. and a shear rate of 10 $s^{-1}$ of at least 40 mPa·s. Preferably, the container 10 is substantially completely coated with oil that is compatible with the product to be filled therein.

The resulting coated container 10 is then filled with viscous product. Preferably, the viscous product has a viscosity at 20° C. and a shear rate of 10 $s^{-1}$ of at least 0.1 Pa·s. Preferably, the container 10 coating process is performed immediately prior to filling.

The inventive process achieves complete and uniform coating, so that the consumer is able to squeeze the container 10 and, in a better and controlled way, completely evacuate viscous product from the container 10.

The term "substantially" as used herein in connection with the inner coating of the squeezable top-down container means coating up to +/−5 mm from the sealing surface at the neck finish of the container 10, and up to 0 mm from the sealing surface, including all ranges subsumed therein, preferably +/−3 mm and most preferably +/−2 mm from the sealing surface at the top of the container 10. For example, coating up to 0 mm from the sealing surface may be achieved by way of the viscous product flowing down the inverted container 10.

The term "complete" as used herein in connection with evacuation of product from the squeezable top-down container means evacuation above 95% and up to 100%, including all ranges subsumed therein.

The term "comprising" is used herein in its ordinary meaning and means including, made up of, composed of, consisting and/or consisting essentially of. In other words, the term is defined as not being exhaustive of the steps, components, ingredients, or features to which it refers.

The term "uniform" as used herein in connection with coating container inner walls means coating the entire container inner wall, with the possible intended exception of +/−3 mm from the opening of neck down toward the closed end along the neck wall, most preferably +/−2 mm from the sealing surface at the top of the container, even if the thickness of the coating is allowed to vary along the wall surface.

The term "viscous" as it refers to packaged product means a formulation that has a viscosity at 20° C. and a shear rate of 10 $s^{-1}$ of at least 0.1 Pa·s. More preferably, the viscosity under these conditions of at least 4.0 Pa·s, even more preferably of at least 7.0 Pa·s and most preferably of at least 10.0 Pa·s.

DETAILED DESCRIPTION OF THE INVENTION

Figure 1:
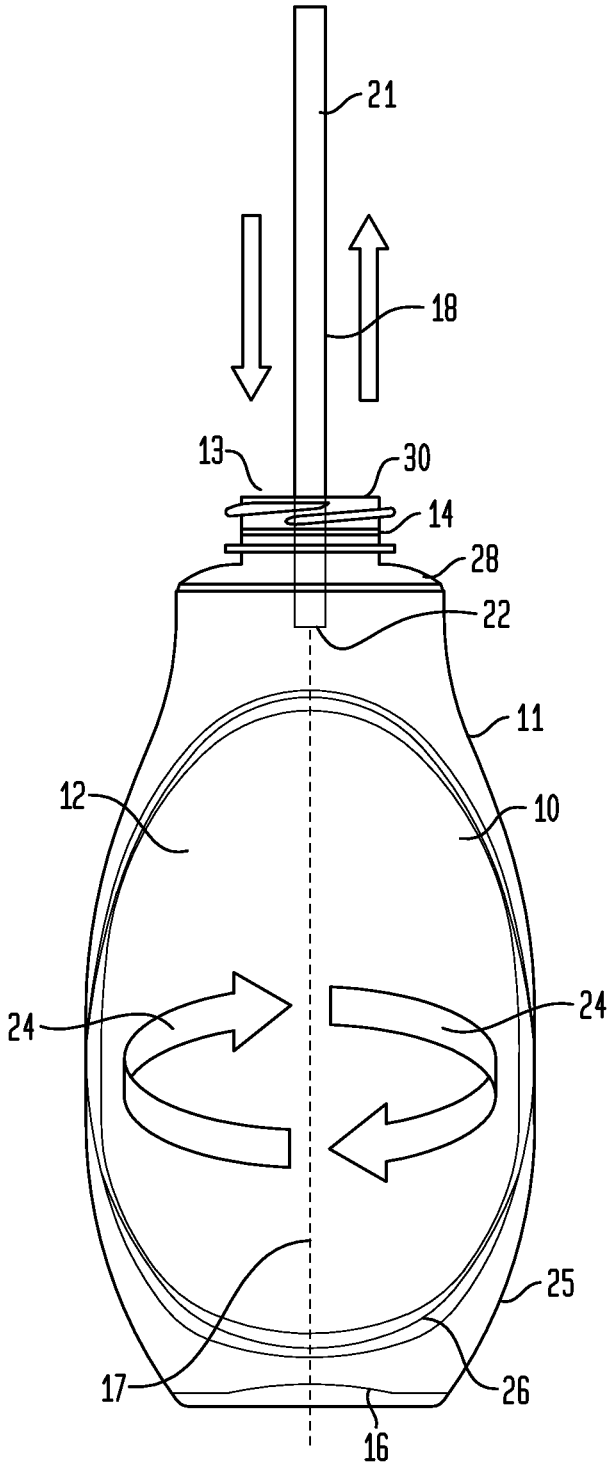
FIG. 1 is a front elevational view of a rotating container used in the inventive process.
Figure 2A:
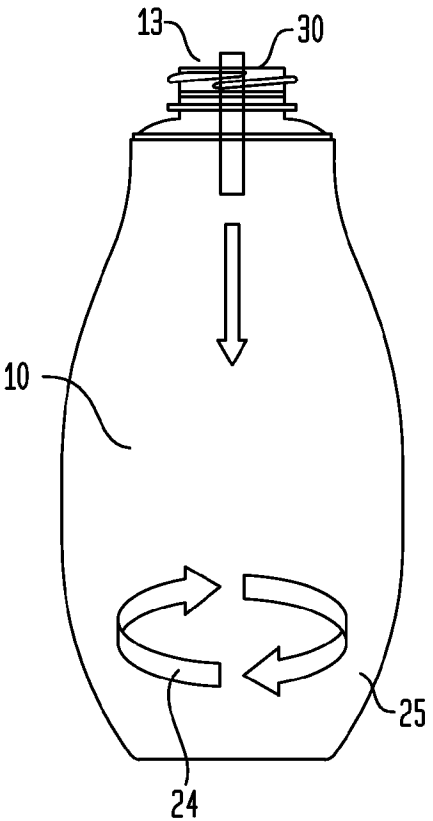
FIG. 2 is a front elevational sequential view of a coating process according to the present invention; with FIG. 2A showing a nozzle assembly entering an empty rotating container, FIG. 2B showing a nozzle assembly that has entered an empty rotating container, FIG. 2C showing the rotating container being coated with an overlapping spray pattern as the nozzle assembly is exiting the container, and FIG. 2D showing a rotating coated container after the nozzle assembly has just exited the container.
Figure 2B:
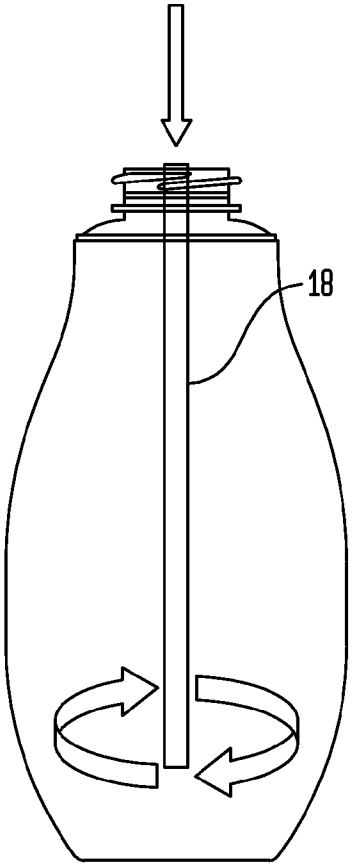
Figure 2C:
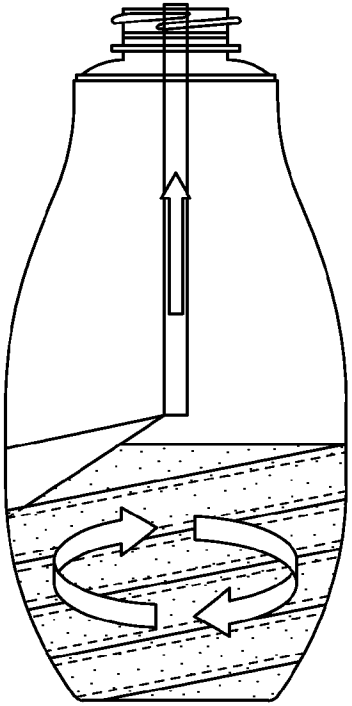
Figure 2D:
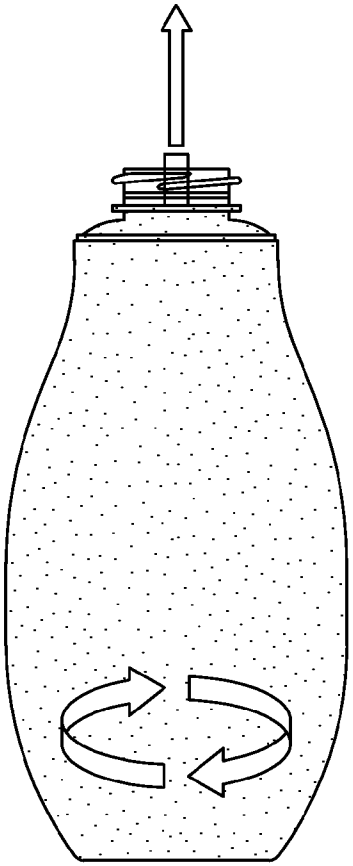

The present invention is motivated by a need for more complete evacuation of viscous products from a container and for better and more efficient methods and equipment of coating the containers. The invention provides a process for the internal coating of a container that is at least partially deformable using an adapted apparatus therefor.

In particular, the process for coating inside a container includes the following steps:

(a) providing a container 10 having a central vertical axis 17 from its closed end to its opening end, comprising:
  (i) a cavity delimited by a wall between the closed end and the open end;
  (ii) the wall comprising an inner surface 25;
  (iii) a neck finish 14 at an opening end of the container 10 opposite the closed end; the container neck 14 terminating in a sealing surface 30 at the opening end;

(b) rotating the container 10 about its vertical axis 17;

(c) lowering an airless spray nozzle assembly 21 along the vertical axis of the container 10 into the cavity through the opening end; the spray nozzle 21 assembly having at least two nozzles 20 with each having orifices therein having an equivalent diameter of 50 to 200 microns;

(d) applying a liquid coating through the nozzle assembly at a spray pressure of 100 to 800 psi (6.89 to 55.16 bar) and at an angle of 0 to 120 degrees relative to the vertical axis 17, simultaneously with nozzle movement, to coat the inner surface 25 while the container 10 is rotating and the nozzle assembly 21 is moving along the vertical axis 17;

thereby coating the inner surface 25 to form an internally coated container.

The invention will now be described further with reference to the embodiment of the process for coating a dispenser by lowering a spray nozzle into a rotating container as shown in the drawings.

With reference to FIG. 1, container 10 has side walls 11 defining inner chamber 12 with orifice 13 at neck 14 and closed base 16 at the opposite end. Chamber 12 is defined by inner surface 25 formed by side walls 11. Container 10 has a vertical axis 17. Sealing surface 30 is provided at orifice 13 of neck 14 positioned in a plane perpendicular to vertical axis 17.

Container 10 is not limited by geometric shape or material of manufacture, and is preferably an upside down container, meaning base 16 is positioned at the top when container 10 stands on cap 23 (not shown) provided to close orifice 13, preferably by threaded or snap-on connection at neck 14. The upside down orientation facilitates use of gravity to evacuate fluid product from container 10. Preferably, container 10 includes transition portion 26 at the closed end and transition portion 28 near the neck.

Figure 7:
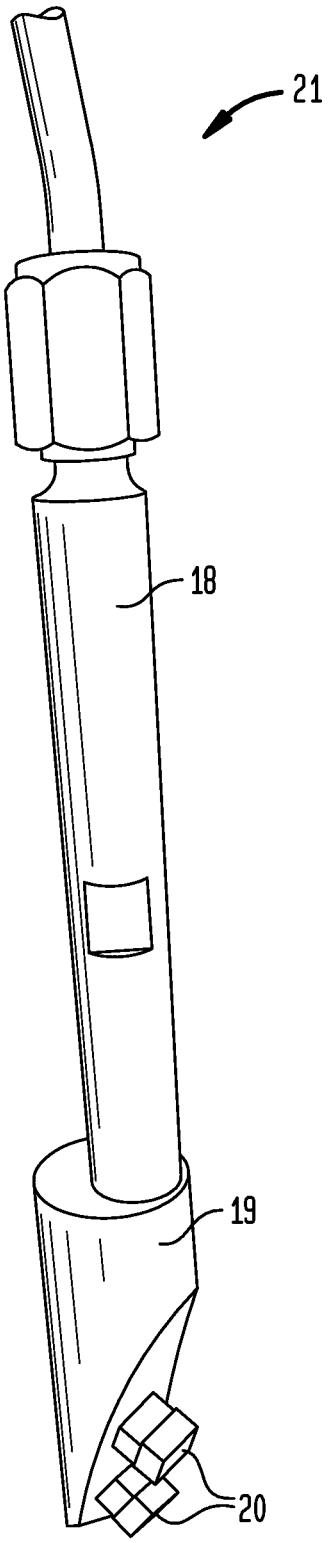
FIG. 7 is a perspective view of a nozzle assembly.

With reference to FIG. 7, nozzle assembly 21 includes elongated hollow extension 18 threadably connected to nozzle adapter 19. Adapter 19 is provided with two spray nozzles 20 mounted at tip 22 of the other (non-threadably connected) end of adapter 19. Nozzles 20 have a plurality of apertures (not shown). Nozzle assembly is positioned to enter chamber 12 with tip 22 first through neck orifice 13 along vertical axis 17. Apertures in nozzles 20 are designed to spray liquid coating compatible with product to be placed inside chamber 12 from the hollow inside extension 18 and nozzles 20. Suitable coatings are discussed below. Nozzles 20 are air-less spray nozzles, which avoid introduction of air into coating and product, thereby avoiding reactions with gases, such as oxidation and mist formation.

Container 10 is capable of rotation as denoted by arrows 24 in either direction, preferably in the counter-clockwise direction as shown in FIG. 1.

With reference to FIG. 2, the inventive process includes spraying liquid coatings via two airless spray nozzles 20 while container 10 is rotating along its vertical axis 17. With reference to FIGS. 1 and 2, the process of coating container 10 begins with Step (a), positioning container 10 for rotation with base 16 at the bottom. Container 10 rotation may be effected by placing container 10 on a rotating plate (FIG. 3B) or by holding container 10 by its neck 14 (FIG. 3A).

While continuing at rotational speeds of about 50 to about 1200 rpm, (b) simultaneously lowering tip 22 of nozzle 18 through orifice 13 of neck 14 into chamber 12 toward base 16, such that nozzles 20 enter container 10 through orifice 13 and along vertical axis 17;

(c) after lowering nozzles 20 a predetermined distance into chamber 12, moving nozzles 20 upwards toward orifice 13 and simultaneously with nozzle 20 movement either up or down (preferably upward), spraying coating through apertures in nozzles 20 (spray pressure of about 100 to about 800 psi (about 6.89 to about 55.16 bar)), thereby coating inner surface 25 of chamber 12 of container 10;

(d) continuing to spray upon upward movement until container 10 is uniformly coated to a predetermined height and nozzles 20 exit chamber 12.

As will be discussed with reference to FIG. 5, oil overlap in a spiral pattern results from container 10 rotation and the particular nozzle 20 configuration.

Figure 3B:
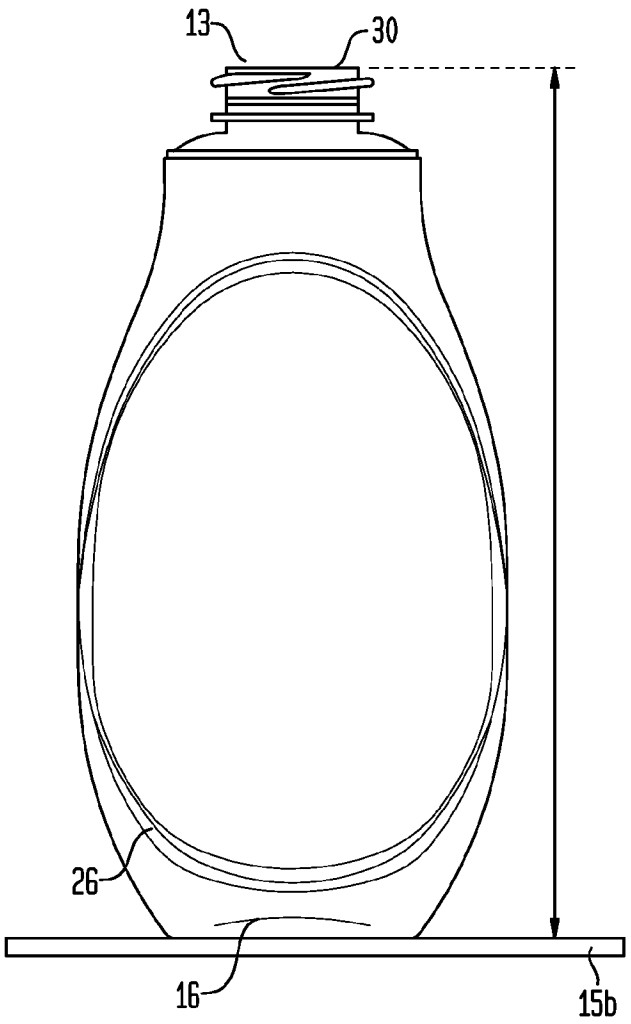
FIG. 3 is a front elevational view of neck held (3A) and base held (3B) containers.
Figure 3A:
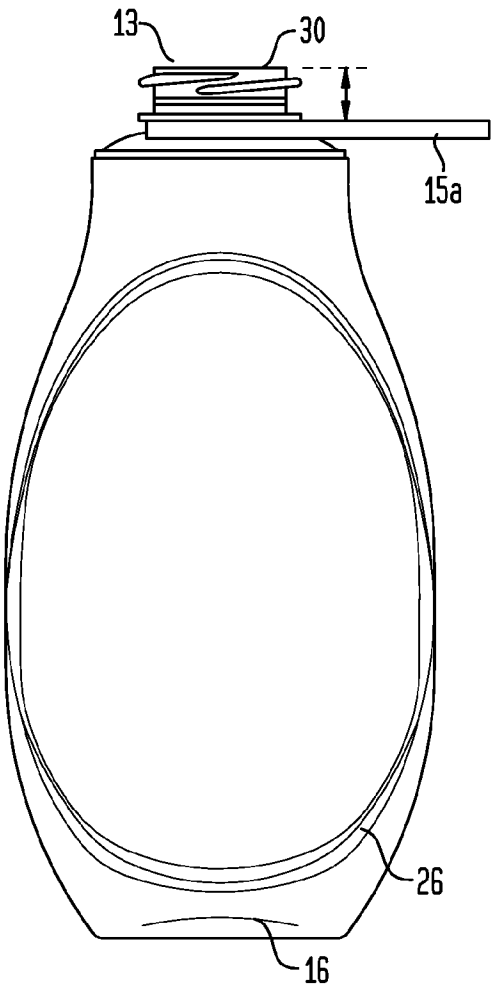

With reference to FIGS. 3A and 3B, neck handled container 10 and base-handled container 10, respectively, are possibly used in the coating process. Neck handling is by way of bottle gripper datum 15*a* at neck. Base handling is by way of bottle gripper datum 15*b* at base 16. Neck 14 portion of container 10 is injection molded, with finer feature tolerances of +/−0.2 mm (denoted by vertical arrow in FIG. 3A). In contrast, the container body is blow molded, with much higher tolerances of +/−1.7 mm (denoted by vertical arrow in FIG. 3A). Neck handling significantly eases accuracy of locating and grasping containers 10 in an automated machine process for handling a plurality of containers 10. Also, injection molded feature tolerances of neck handling significantly increase the accuracy of the coating boundary compared with blow molded tolerances (+/−1.7 mm) and coat much closer to sealing surface 30 on orifice 13 without contamination of sealing surface 30. Contamination of sealing surface 30 is to be avoided as it would prevent adequate induction sealing.

Figure 4:
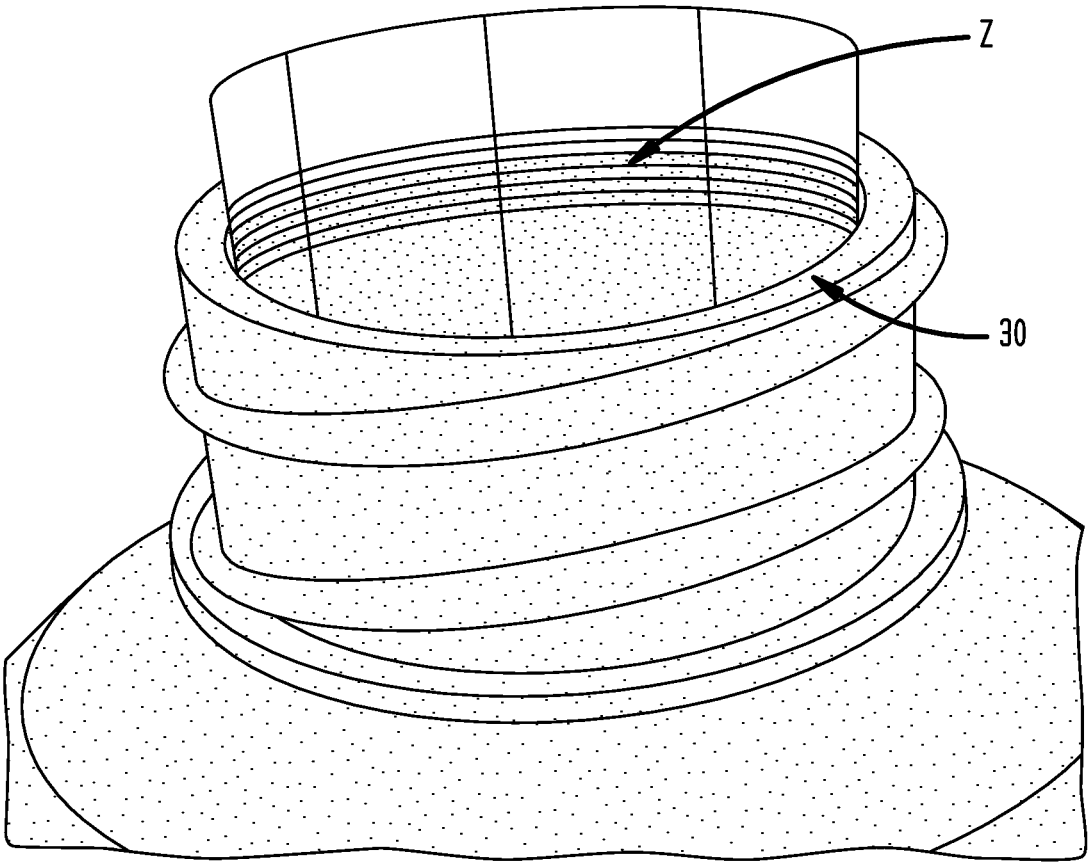
FIG. 4 is a perspective view of the coated container neck.

Some variance in coating weights is acceptable, provided substantially entire coating is achieved. Preferably, the overall coating weight is as low as possible in order to avoid contaminating the product, while achieving sufficiently entire internal coating. Without wishing to be bound by theory it is believed centrifugal force generated during the rotation helps achieve a more even and consistent coating thickness, as without the rotation the coating thickness varies significantly, possibly leaving some portions of the container with considerably less coating, and thus lower evacuation performance. Therefore, it is believed that the concept of rotating container 10, while simultaneously spraying liquid coatings with a vertically moving airless nozzles 20, the resulting "blade-like" spray pattern enables very precise control, particularly in the neck 14 area to avoid contamination of the container's neck sealing surface 30 (in order to apply an induction seal, this area should be clean), as shown in FIG. 4. Precise control of spray pattern results in precise coating levels Z.

Figure 5:
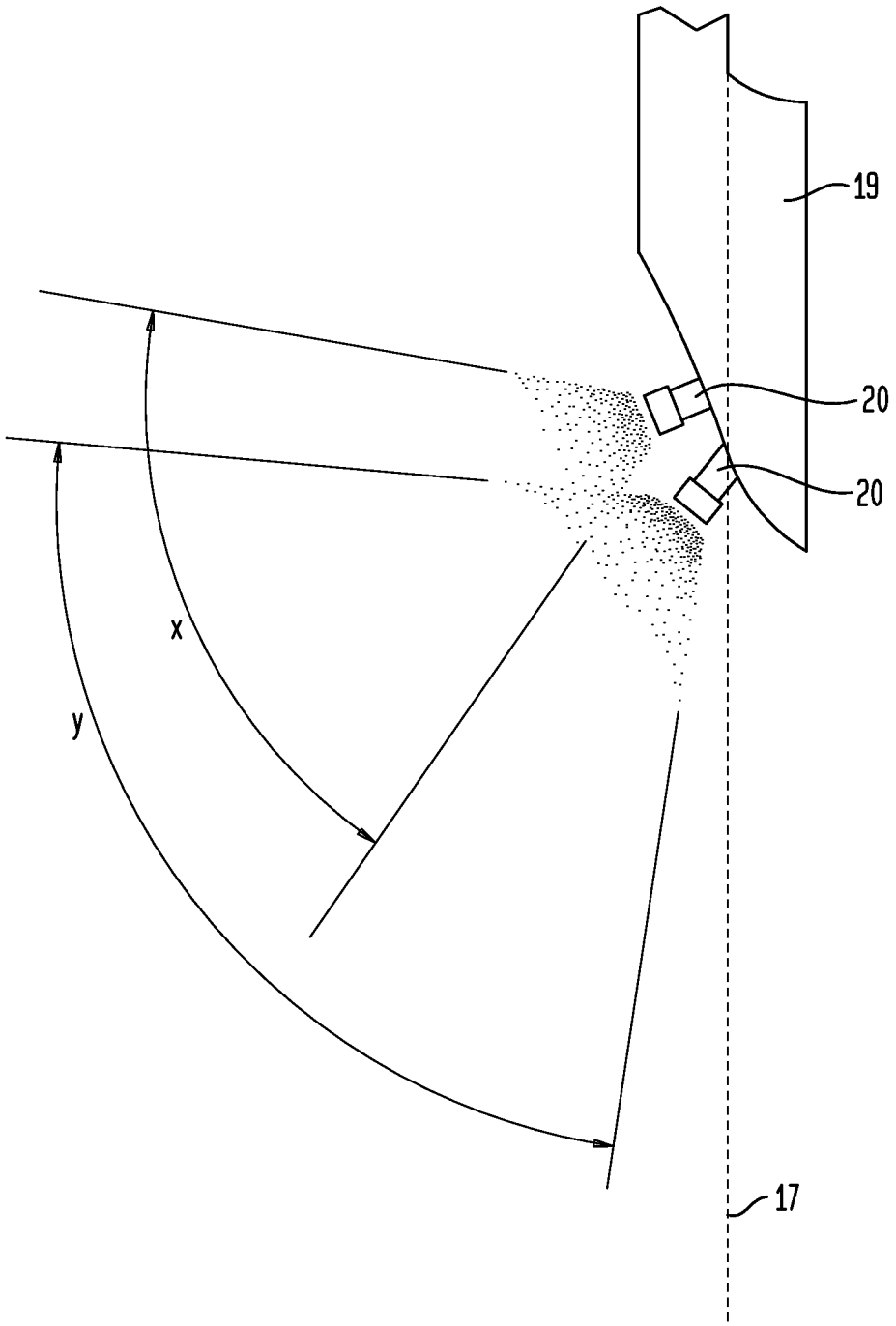
FIG. 5 is a sectional diagram of the blade spray pattern.
Figure 6B:
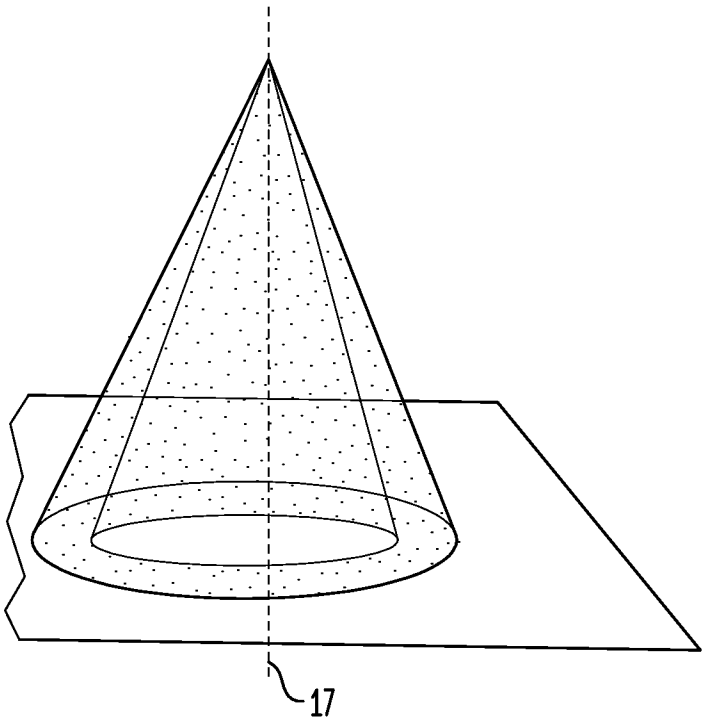
FIG. 6 is a perspective diagram of a blade spray pattern (6A) and a cone spray pattern (6B)
Figure 6A:
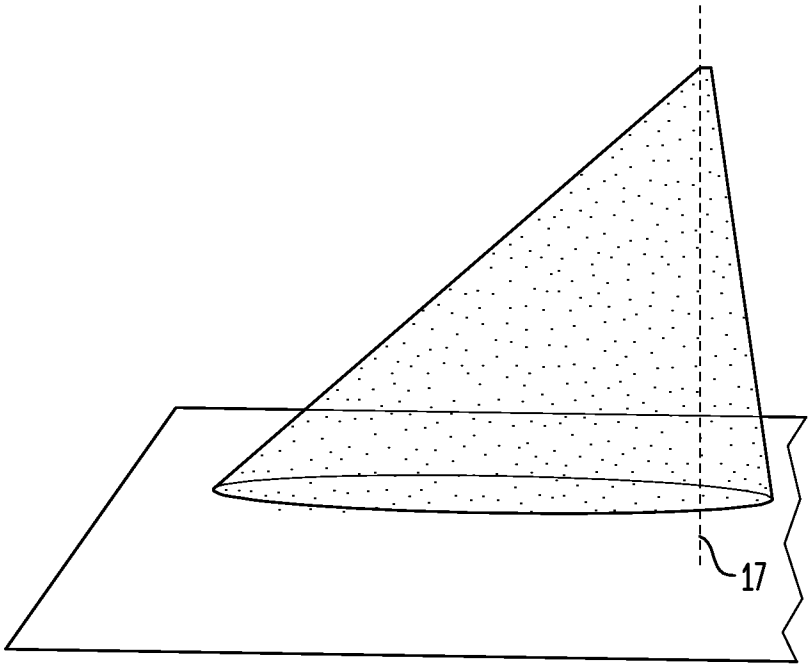

With reference to FIGS. 5, 6 and 7, nozzles 20 are selected so as to provide a blade shaped spray pattern as shown in FIG. 6A, resulting in accuracy and control in applying coating. This is in contrast to the cone shaped spray pattern shown in FIG. 6B. Nozzles 20 having aperture or orifice sizes of 50 micron to 200 micron, preferably 70 to 150 micron (equivalent diameter) are preferred to apply a very low coating thickness, at an acceptable bottle rotation speed which is practical for an industrial operation. With reference to FIG. 5, the blade spray pattern is directed at angles X, Y between 0 and 120 degrees to container vertical axis 17 to ensure that all surfaces receive a complete coating.

Specifically, FIG. 5 illustrates the preferred angles of spray of nozzles 20, with the lower nozzle spraying at angle Y of about 88 degrees and the upper nozzle spraying at angle X of about 68 degrees relative to vertical axis 17. The wider angle nozzle allows for much oil overlap in a spiral pattern resulting from container rotation. The narrower spray angle allows for accurate control. Too narrow a spray angle would result in uncoated or non-uniformly coated inner surface. In contrast with the blade pattern in FIG. 6A, with reference to FIG. 6B, more common solid or hollow cone shaped spray patterns, which would be directed along the container axis 17 (without the need for container or nozzle rotation) would not allow this degree of accuracy, and would either under or over-coat the base, and/or contaminate the sealing surface and external surfaces of the container, when applying a complete internal coating.

Container

Although not limited by material of manufacture, container 10 may be squeezable or may be a jar of any shape, it is preferably squeezable, meaning it deforms upon application of manual squeezing pressure. The container or bottle is preferably manufactured from a plastic material, preferably PET (polyethylene terephthalate) material. The container may be either transparent or non-transparent.

Preferably, container 10 is bottom opening. However, it is not excluded that the dispenser 10 may also be oriented with the opening pointing upward, for instance during transport or even in store or on display at the location of the retailer. Container 10 may have text and image imprints on the outside thereof for customer information. Such imprints will be readily discernible in case container 10 is oriented according to the nominal position with the bottom opening pointing downward.

Preferably, container 10 is completely and uniformly coated with oil. Preferably, container 10 manufacturing and coating process is performed immediately prior to filling. The resulting coated container 10 is then filled with viscous product. By way of illustration, a viscous product that is advantageously packaged in container 10 coated according to the inventive process may include formulations such as ketchup, mustard, mayonnaise, shampoo, conditioner, body wash, and variations thereof regardless of the standard of identity. Typically a viscous product has a viscosity at 20° C. and a shear rate of 10 $s^{-1}$ of at least 0.1 Pa·s, preferably at least 1.0 Pa·s. More preferably, the product has viscosity under these conditions of at least 5.0 Pa·s, even more preferably of at least 8.0 Pa·s and most preferably of at least 10.0 Pa·s.

Coating Materials

A liquid coating compatible with the viscous product to be packaged in container 10 is used according to the process of the present invention, to ensure the quality of the viscous product. For example, for mayonnaise product, edible oil is used to internally coat container 10. An aqueous coating may be more suitable to another kind of product. Oil-in-water and/or water-in-oil emulsions may also be used as coating materials.

Suitable coating materials include liquids having a viscosity of between 40 and 70 mPa·s at 25° C. A few examples in food applications include soya bean, rapeseed, sunflower, olive, palm and coconut oils. Preferably, an oil based coating is selected to contain relatively low amounts of polyunsaturated fatty acids (PUFA). To keep the oil coating oxidation level below a detectable off-taste for a food consumer, the peroxide value (POV) limit is kept below about 1 meq/kg.

Preferably, where the viscous product is mayonnaise, the container is made from PET container and is coated with edible oil.

The evacuation coating not only enables consumers to evacuate considerably more viscous product (e.g. mayonnaise) from plastic packaging, leaving them with significantly less residual waste, but it also results in less waste sent to landfill, and removes the issue of unsightly voids (bubbles) in the viscous product when seen by the consumer on the supermarket shelf.

In the following, several examples of application of the inventive method are described and compared. The following is by way of example, not by way of limitation, of the principles of the invention to illustrate the best mode of carrying out the invention.

EXAMPLES

Examples 1 and 1A

Two processes using spray coating were compared for substantial completeness of coating of inner walls of container 10. The following oils were used in these examples: soybean, sunflower, rapeseed, and olive oils. Bottles of different sizes were tested. The smallest size was 175 ml with a height of 120 mm and width of 63 mm. The largest size bottle size was 750 ml with a height of 202 mm and width of 95 mm.

Nozzles 20 were obtained from Nordson Corporation, with a head office at 28601 Clemens Road, Westlake, Ohio 44145-4551 USA. Nozzles 20 with the smallest orifice size were selected, i.e. NORDSON brand, Part number 1602321, resulting in very low coating weights (0.5 g/430 ml bottle) and control especially around the neck area. Nozzles 20 of the next biggest size are suitable for coating the rest of the interior of container 10, i.e. NORDSON brand, Part number 1602322.

In Example 1, the coating was performed via dynamic or moving nozzle assembly 21 according to the present invention. This effect is illustrated in FIG. 2. It was observed that transition portions 26, 28 were completely coated, thereby resulting in a coated container 10. During the coating step illustrated in FIG. 2C, a slight overlap of the spray pattern was observed during the process, which was evened out by rotation of container 10. The overlap in the spray pattern is shown by the broken lines, showing an overlap of up to about 30%. The combination of overlap of successive blade patterns filling in gaps, together with container rotational speed imparting energy to the coating and causing it to migrate, results in complete coverage. In addition, the centrifugal action causes the oil layer to flatten out to a uniform coating layer.

In comparative example 1A, a static or fixed conventional nozzle was used to perform the coating. It was observed that transition portions 26, 28 were difficult to coat, thereby resulting in partially coated container 10. Furthermore, additional nozzles had to be used with the fixed/static nozzle system. This resulted in less control, more variation and instability of the process, and applying far too much oil to the bottle. Too much oil leads to a negative visual impact for the consumer (in clear packs), increased material cost and a high risk that excess oil will leave container 10 with formulation, as was observed with shampoo products, leading the consumer to believe the formulation has separated or is defective. Small changes in either temperature and/or pressure can strongly influence the fan pattern angles. With a static/fixed nozzle system, a large number of different nozzles and nozzle adaptors to coat bottles of different sizes and shapes would be required, not to mention the change-over time required in the factory. The more nozzles, the greater the risk of either patterns overlapping too much, resulting in too much oil being applied, or patterns not meeting and resulting in un-coated surfaces inside container 10, and thus a partially coated container 10.

Furthermore, it was found that the technique of FIG. 2, Example 1, according to the present invention is much more effective to achieve substantially complete coating, with controlled amounts of coating weight. A dynamic nozzle system offers much greater flexibility, allowing simple re-programming the "motion-profile" (speed of rotation+speed at which the nozzle enters and exits the bottle) to adapt the system to suit any bottle size and geometry.

The drawings and the foregoing description are not intended to represent the only forms of the container and methods in regard to the details of construction and performance. Changes in form and in proportion of parts, as well as the substitution of equivalents, are contemplated as circumstances may suggest or render expedient.

The invention claimed is:

1. A process for coating and filling a container comprising:

(a) providing a container (10) made from PET having a closed end and an opening end, and further having an imaginary central vertical axis (17) extending from its closed end to its opening end, characterized by the container (10) comprising:

(i) a cavity delimited by a wall between the closed end and the opening end;

(ii) the wall comprising an inner surface (25);

(iii) a neck finish (14) at an opening end of the container (10) opposite the closed end; the container neck (14) terminating in a sealing surface (30) at the opening end;

(b) rotating the container (10) about its vertical axis (17) at rotational speeds of 50 to 1200 rpm;

(c) lowering an airless spray nozzle assembly (21) along the vertical axis of the container (10) into the cavity through the opening end; the spray nozzle assembly having at least two nozzles (20) with each having orifices therein having an equivalent diameter of 50 to 200 microns;

(d) applying a liquid coating, wherein the liquid is an edible oil, through the nozzle assembly (21) at a spray pressure of 100 to 800 psi (6.89 to 55.16 bar) and at an angle of 0 to 120 degrees relative to the vertical axis (17), simultaneously with nozzle movement, to coat the inner surface (25) while the container (10) is rotating and the nozzle assembly (21) is moving along the vertical axis (17);

thereby coating the inner surface (25) to form an internally coated container, and further comprising filling the internally coated container with mayonnaise compatible with the coating.

2. The process according to claim 1, wherein the container is manufactured and coated immediately prior to filling.

3. The process according to claim 1, wherein said mayonnaise has a viscosity at 20° C. and a shear rate of 10 $s^{-1}$ of at least 0.1 Pa·s.

* * * * *